United States Patent [19]

Neff

[11] Patent Number: 4,502,742

[45] Date of Patent: Mar. 5, 1985

[54] STORAGE UNIT

[76] Inventor: Paul J. Neff, 1143 Mississauga Rd., Mississauga, Ontario, Canada, L5H 2J1

[21] Appl. No.: 455,633

[22] Filed: Jan. 5, 1983

[51] Int. Cl.[3] ..... A47B 46/00

[52] U.S. Cl. ..... 312/324; 312/138 R; 312/329

[58] Field of Search ..... 312/138 A, DIG. 33, 312/297, 298, 129, 258, 324, 138 R, 329; 211/60 R

[56] References Cited

U.S. PATENT DOCUMENTS

| | | | |
|---|---|---|---|
| 40,088 | 9/1863 | Bacon | 312/324 |
| 620,013 | 2/1899 | Barnes | 312/324 |
| 658,880 | 10/1900 | Tandy | 211/60 R |
| 850,210 | 4/1907 | Cady | 312/324 |
| 1,128,031 | 2/1915 | Needleman | 312/258 |
| 2,414,752 | 1/1947 | Mabie | 312/324 |
| 3,089,745 | 5/1963 | Postula et al. | 312/324 |
| 4,095,860 | 6/1978 | Henson | 312/324 |
| 4,170,392 | 10/1979 | Spevak | 312/DIG. 33 |
| 4,286,832 | 9/1981 | Spevak | 312/DIG. 33 |
| 4,396,240 | 8/1983 | Henson | 312/138 A |

FOREIGN PATENT DOCUMENTS

| | | | |
|---|---|---|---|
| 332963 | 6/1903 | France | 312/324 |

*Primary Examiner*—William E. Lyddane
*Assistant Examiner*—Thomas A. Rendos
*Attorney, Agent, or Firm*—Rogers, Bereskin & Parr

[57] ABSTRACT

A storage unit such as a pantry cupboard for a kitchen is disclosed. The unit includes a cabinet enclosure and a pair of doors for closing the enclosure. A pair of bi-fold panels are provided inside the enclosure and are hinged to respectively opposite sides of the enclosure so that each pair of panels can be disposed in a folded configuration when the doors are closed, or extended out of the enclosure when the doors are open. The inner face of each panel is provided with storage racks arranged in a superimposed series and the panels are inset into the cupboard to an extent sufficient to accommodate the racks.

9 Claims, 3 Drawing Figures

STORAGE UNIT

This invention relates generally to a storage unit such as a closet, cupboard, cabinet or the like and has for its object to provide a unit having an improved internal storage arrangement as compared with conventional such storage units.

The storage unit provided by the invention includes an enclosure defining an internal storage space and an opening providing access to said space and disposed in a generally vertical plane. At least one door is hinged to the enclosure adjacent the opening and is capable of closing the opening. The unit also includes at least one pair of panels disposed in generally vertical planes and defining adjacent side edges, the panels being hinged together about said edges so as to be capable of selectively adopting a folded configuration in which outer faces of the panels are disposed inwardly towards one another, and an extended configuration in which inner spaces of the panels are disposed. A plurality of individual storage racks are disposed on the inner faces of the panels. An inner one of the panels is hinged to the enclosure at a location within said space selected to permit the panels to be disposed in their folded configuration with said door closed, and to be extended from the enclosure in their extended configuration when the door is open, for permitting access to said storage racks.

A storage unit of the form provided by the invention has been found to be particularly suitable for use in a kitchen environment, for example, as a "pantry" cupboard. In this event, the individual storage racks may in fact be in the nature of narrow shelves suitable for receiving size canned goods or spice jars having a restraining edge or wall surrounding each shelf. In one example, the racks may be of the form typically known as "spice racks".

In order that the invention may be more clearly understood, reference will now be made to the accompanying drawings which illustrate a preferred embodiment of the invention by way of example, and in which.

Figure 1:
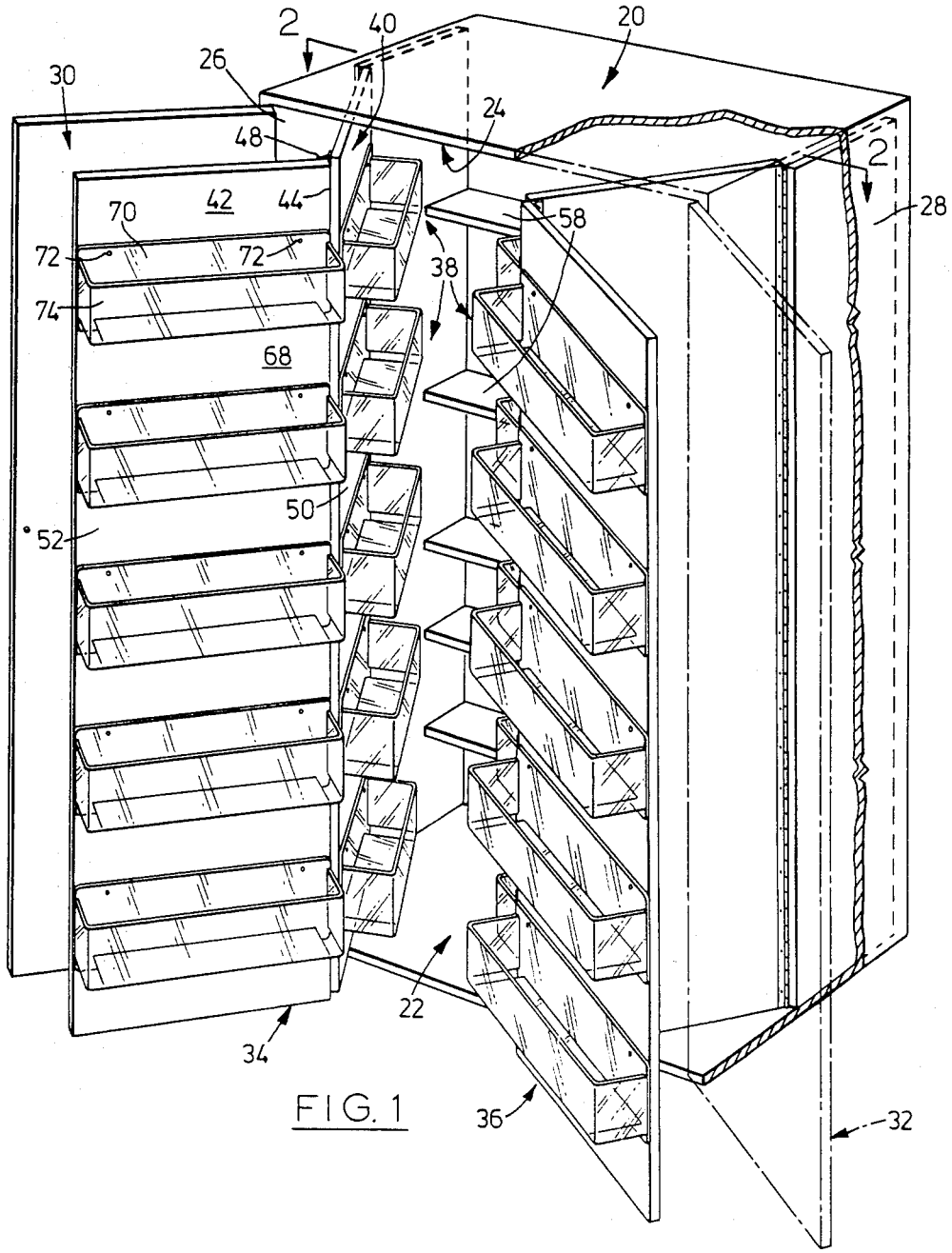
FIG. 1 is a perspective view of a storage unit according to the invention shown partly open.

As shown in the drawings, the storage unit has been designed primarily for use as a "pantry" cupboard or the like for a kitchen. The unit includes an enclosure which in this embodiment takes the form of a cabinet enclosure and which is generally denoted by reference numeral 20. Constructional details of the enclosure have not been shown in the drawings since they are conventional. For present purposes it is sufficient to note that the enclosure is generally rectangular and defines an internal storage space 22 and an opening 24 providing access to said space. Side walls of the enclosure are denoted 26 and 28 respectively. The enclosure is fitted with a pair of doors 30 and 32 which are hinged to the said panels 26 and 28 in conventional fashion. In FIG. 1, door 32 and adjacent parts of the cabinet enclosure 20 have been shown in ghost outline to reveal internal structure (to be described). The doors are shown open in FIGS. 1 and 2 and closed in FIG. 3. Suitable catches (not shown) will be provided for retaining the doors in their closed positions.

The storage unit as described this far is essentially conventional. In accordance with the invention, the unit includes at least one pair of "bi-fold" panels which are hinged to the enclosure at a location within the storage spaces defined by the enclosure and which can be selectively disposed in a folded configuration or an extended configuration and in which inner faces of the panels are provided with a plurality of individual storage racks.

In the illustrated embodiment, two pairs of bi-fold panels are in fact provided and the pairs of panels are denoted by reference numerals 34 and 36. The individual storage racks carried by these panels are generally indicated by reference numeral 38. The two pairs of panels are essentially identical but of respectively opposite "hand". Thus, referring to the pair denoted 34 by way of example, the individual panels are denoted respectively 40 and 42 and are substantially the same shape and size. Each panel is of narrow rectangular shape and the panels have adjacent side edges 44 and 46 at which the panels are hinged together by a continuous "piano" type hinge 48 which extends over the entire length of the respective edges. The panels are made of wood and the two leaves of hinge 48 are secured to marginal portions of the panels by screws (not shown). Each of the panels is in fact of a form typically found in kitchen cabinet construction and comprises a particle board covered with a coating of polyvinyl chloride.

Figure 3:
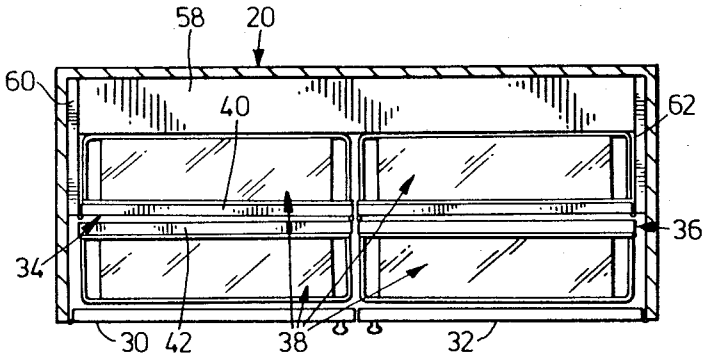
FIG. 3 is a view similar to FIG. 2 but showing the storage unit closed.

Inner faces 50 and 52 respectively of the two panels 40 and 42 are visible in FIG. 1 and these are the faces which carry the storage racks 38. Outer faces of the same panels are not visible in FIG. 1 but are denoted 54 and 56 respectively in FIG. 2. The hinge between the two panels permits the panels to be moved between a folded configuration in which the outer faces 54 and 56 of the panels are disposed inwardly towards one another, and an extended configuration in which the inner faces 50 and 52 of the panels are exposed to the exterior of the unit as shown in FIG. 1. The panels are also hinged to the cabinet enclosure 20 within the storage space 22 at a location selected to permit the panels to be disposed in their folded configuration within the space 22 when the exterior doors 30 and 32 of the storage unit are closed, and to be extended from the enclosure for permitting access to the storage racks when the doors 30 and 32 are open. The storage unit is shown in this latter configuration in FIG. 2 of the drawings and is shown in FIG. 3 with both pairs of panels folded and the doors 30 and 32 closed. As seen in FIG. 3 the folded doors are in generally co-planar and closely spaced relationship extending across substantially the entire width of the enclosure. The storage racks 38 on the outer panels 42 are then exposed behind the doors 30, 32.

Figure 2:
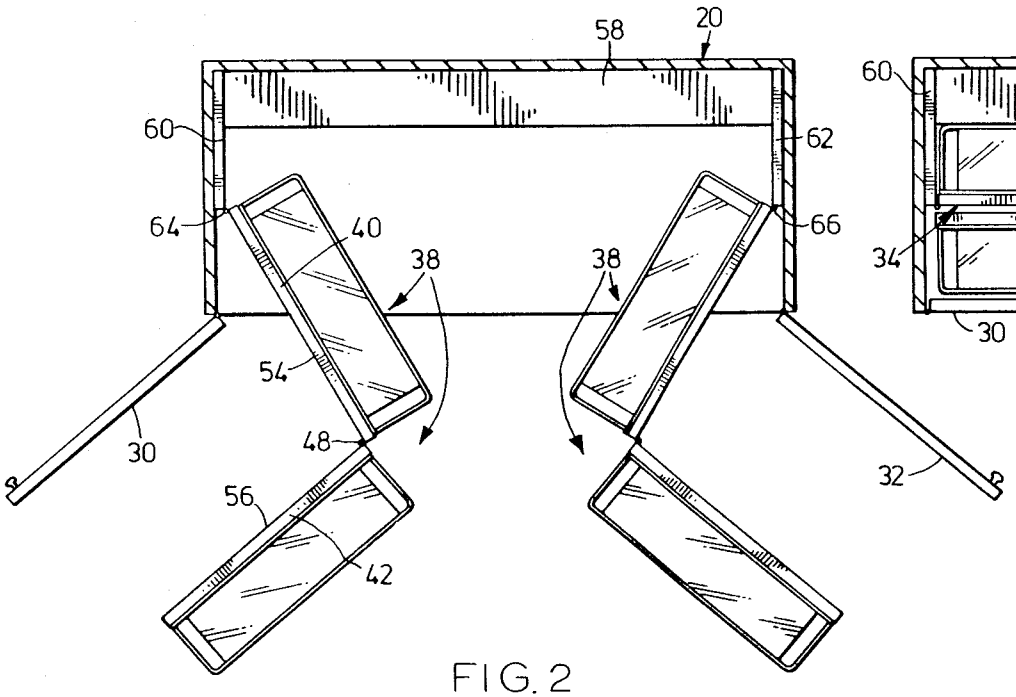
FIG. 2 is a sectional plan view on line 2—2 of FIG. 1.

It will be appeciated that the depth of the storage racks 38 and the thickness of the panels effectively dictate the location at which the panels must be hinged to the cabinet enclosure if the doors 30 and 32 are to be able to be closed. Horizontal shelves such as are normally provided within a kitchen cupboard are provided in enclosure 20 and are individually denoted by reference numeral 58. The shelves must be of reduced depth compared with the full depth of enclosure 20 in order to accommodate the storage racks 38. As shown in FIGS. 2 and 3, the shelves 58 are in fact quite narrow and terminate clear of the storage racks 38 when the bi-fold panels are folded. This ensures that the racks will not interfere with articles on the shelves. In another embodiment, the shelves could be deeper and arranged to extend between vertically adjacent ones of the storage racks 38 provided the spacing between those racks was sufficient to allow reasonable clearance above each shelf.

The innermost panel in each pair 34, 36 is hinged to the enclosure to provide for the required folding action of the panels. In this particular embodiment, each of the inner panels is in fact hinged to a separate mounting panel secured to the relevant inner side wall of cabinet enclosure 20. The two mounting panels are denoted respectively 60 and 62 and are secured to the respective walls of enclosure 20 by screws (not shown). The relevant panel in each pair 34, 36 is hinged to the associated mounting panel 60 or 62 by a continuous piano hinge, the two hinges being denoted 64 and 66 in FIG. 2. This manner of securing the bi-fold panels by means of an intermediate mounting panel is particularly convenient in that it allows the bi-fold panels to be readily fitted inside a cabinet enclosure which has been previously manufactured. In fact, the bi-fold panels could conveniently be fitted into an existing cupboard in this way. The width of the mounting panels is selected so that, when a particular panel is fully seated into the corner of the cabinet enclosure, the bi-fold panels are automatically positioned at the required inset from opening 24 to be accommodated when the doors 30 and 32 are closed. However, in an alternative embodiment, the inner panels of the respective pairs could of course be hinged directly to the cabinet enclosure.

In this embodiment, the racks 38 are all essentially the same and are in fact in the nature of spice racks. The racks are manufactured from transparent or smoked plastic material of the type which is typically sold under the trade mark PLEXIGLASS. Referring to the rack which appears at the top of panel 42 in FIG. 1 by way of example, the rack is generally somewhat trough-shaped and includes a relatively narrow shelf 68 which forms the base of the trough, a back panel 70 which is secured to panel 42 by screws 72 passing through holes in panel 70, and a panel 74 which forms a border around shelf 68 for confining spice jars and the like on the shelf. Shelf 68 terminates clear of the border at its ends. Of course, there is no limitation to this particular form of a rack and other racks could well be used. Also, the racks need not all be the same.

As indicated previously, the drawings show a particular preferred embodiment of the invention in which the storage unit takes the form of a pantry cupboard for a kitchen. It will of course be understood that the invention is not limited to this particular application. Also, various modifications of the described embodiment are of course possible within the broad scope of the invention. Examples of some such modifications are discussed above. Another possible modification would be to employ a single pair of bi-fold panels rather than the two pairs shown in the drawings. A single exterior door could of course be used instead of two exterior doors on the cabinet enclosure. Also, the enclosure itself need not be a physical structure but could, rather, take the form of an alcove or a recess in a wall.

I claim:

1. A storage unit comprising:

an enclosure defining an internal storage space and an opening providing access to said space and disposed in a generally vertical plane;

at least one door hinged to the enclosure adjacent said opening and capable of closing the opening;

first and second pairs of panels, the panels in each pair being disposed in generally vertical planes and defining adjacent side edges, the panels being hinged together about said edges to permit the panels to selectively adopt a folded configuration in which outer faces of the panels are disposed inwardly towards one another, and an extended configuration in which inner faces of the panels are exposed; and, a plurality of individual storage racks disposed on said inner faces of each of the panels;

inner ones of each pair of panels being hinged to respectively opposite sides of the enclosure at locations within said space selected to permit both pairs of panels to be (1) disposed in folded configurations and in generally co-planar and closely spaced relationship extending across substantially the entire width of said enclosure with said door closed and said racks on outer ones of said panels exposed behind the door, and (2) to be extended from the enclosure in said extended configuration when the door is open for permitting access to said storage racks.

2. A unit as claimed in claim 1, wherein each said panel is provided with a series of said individual storage racks arranged in vertically superimposed positions on said inner face of the panel.

3. A unit as claimed in claim 2, wherein said individual storage racks are all substantially identical, each rack comprising a relatively narrow shelf surrounded by a border for confining articles on said shelf.

4. A unit as claimed in claim 1, wherein the panels in each pair are hinged together by a continuous piano hinge extending over substantially the entire length of said panels.

5. A unit as claimed in claim 1, wherein said panels are all substantially identical and each panel is of relatively narrow and tall rectangular shape.

6. A unit as claimed in claim 1, further comprising respective mounting panels to which said inner ones of the pairs of panels are hinged, said mounting panels being secured to opposite inner side walls of said enclosure.

7. A unit as claimed in claim 1, wherein said enclosure is a cabinet structure having opposite side walls to which each of said pair of panels is hinged.

8. A unit as claimed in claim 1, comprising two said doors which are substantially identical and which are hinged to respectively opposite sides of said enclosure and adapted to co-operate and close said opening.

9. A unit as claimed in claim 1, wherein each said panel comprises a particle board panel core enclosed by a covering of polyvinyl chloride.

* * * * *